US007000395B2

(12) United States Patent
Wai et al.

(10) Patent No.: US 7,000,395 B2
(45) Date of Patent: Feb. 21, 2006

(54) HYBRID CLEAN-ENERGY POWER-SUPPLY FRAMEWORK

(75) Inventors: Rong-Jong Wai, Liouying Township (TW); Rou-Yong Duan, Guosing Township (TW)

(73) Assignee: Yuan Ze University, Jhongli (TW)

( * ) Notice: Subject to any disclaimer, the term of this patent is extended or adjusted under 35 U.S.C. 154(b) by 0 days.

(21) Appl. No.: 10/797,965

(22) Filed: Mar. 11, 2004

(65) Prior Publication Data

US 2005/0198963 A1 Sep. 15, 2005

(51) Int. Cl.
*F01B 23/08* (2006.01)
*H02J 7/00* (2006.01)

(52) U.S. Cl. ..... 60/698; 290/1 R; 320/101

(58) Field of Classification Search ..... 60/698; 290/1 R; 320/101, 102
See application file for complete search history.

(56) References Cited

U.S. PATENT DOCUMENTS 4,462,213 A * 7/1984 Lewis ..... 60/698
5,512,787 A * 4/1996 Dederick ..... 290/4 R
6,372,978 B1 * 4/2002 Cifaldi ..... 136/248
6,674,263 B1 * 1/2004 Agbossou et al. ..... 320/101
6,787,258 B1 * 9/2004 Prerad ..... 429/21

* cited by examiner

*Primary Examiner*—Sheldon J Richter
(74) *Attorney, Agent, or Firm*—Tracy M Heims; Apex Juris, PLLC

(57) ABSTRACT

A hybrid clean-energy power-supply framework integrates a fuel cell, solar cell, and wind energy, applies a max power tracking rule, raises the output power of a solar cell and wind energy to supply a power load and transfer the surplus electrical energy to a water-electrolyzing apparatus for producing hydrogen and oxygen, and provides a fuel for a fuel cell power generating system. Furthermore, the present invention utilizes features of each clean-energy power generating system, depends on the powerful calculation capacity of a central processing unit to monitor and dispatch each power generation and supply system, and thus ensures the reliability of supply power and reduces the power generation cost. Such a framework can selectively grid-connect with the utility power or run as a stand-alone power supply system and has a mechanism for preventing the island effect.

7 Claims, 6 Drawing Sheets

HYBRID CLEAN-ENERGY POWER-SUPPLY FRAMEWORK

BACKGROUND OF THE INVENTION

1. Field of the Invention

The present invention relates to a hybrid clean-energy power-supply framework, particularly to a hybrid clean-energy power-supply framework that integrates a fuel cell, photovoltaic, and wind energy into green-energy.

2. Description of the Prior Art

In recent years, developing alongside a global rise in environmental consciousness and the problem of greenhouse effect brought by carbon dioxide pollution, the application of renewable energy becomes a noticeable issue and the sustainable development concept further becomes the major motive force of clean-energy promotion.

A fuel cell, dependent on an electrochemical reaction to generate electrical energy without combustion, using hydrogen and oxygen to produce an electron flow for generating an electrical current, water, and heat, produces almost no pollution. The function of a fuel cell is similar to a battery but different, that is, electricity generated by a fuel cell neither runs exhausted nor need to be charged if fuel sufficient. Because electrical energy of a fuel cell can be generated on condition that a fuel presents, a fuel cell is a kind of energy conversion apparatus, therefore problems of the service life of periodical recharge limited and abandoned batteries bringing the environmental pollution of a conventional battery, can be eliminated. Therefore, problems of the service life of rechargeable batteries and abandoned batteries, that may cause environment pollution, can be eliminated. If the fuel cell has a converter for converting a natural gas or other fuel into hydrogen, then those fuels can be used in a fuel cell. Therefore the present invention, collocated with an electrolyzing system to directly obtain hydrogen and oxygen from water, no need to obtain hydrogen from other fuel such as a natural gas, is completely self-sufficient and thus achieves the object clean energy.

Solar energy is the largest energy source in the solar system and due to the advancement in the conversion efficiency of a solar cell and great progress in the semiconductor industry, both cause the continual lowering of the cost of a solar cell, and thus the economical practices of solar energy is emerging. Since Taiwan is located in the subtropical zone, in plenty of light, suitable for the development of solar energy, stable illumination can provide stable power output, and the equipment maintenance is easy, thus solar energy will become a primary power source in the future.

Wind-power is a renewable energy with less pollution and some nations abundant in wind resources already have been setting forth a lot of development, particularly belongs to a green-electricity, and supported by more people, the capacity installed is increasing recently and thus creates remarkable contributions on world energy development and environmental protection.

At present, the cost of the above-mentioned power generation facilities are still high and because a rise in environmental consciousness and each nation in the world is continuously promoting and encouraging development with installation subsidy, facilitated by constant R&D, the speed of cost reduction is accelerated. Reportedly, the cost of wind-power already was reduced below NT$2.0/KWH. As regards the price of the fuel cell and photovoltaic are still much higher than the utility power, however, when the utility power demand grows larger and the manufacture technology advances and mass production of green-power is available, approaches to the price of conventional power generator can be looking forward. Based on the forecast that the power-cost will balance the cost of equipment, fuel, and maintenance in the future, the present invention integrates a clean-energy power-supply systems to facilitate promoting usefulness thereof.

The power characteristics of those three above-mentioned power generating system have highly nonlinear relationships. At present, a device of feeding a single system into a utility power has been developed, but it is not considered a mechanism for feeding those three systems into the utility power together. Moreover, a function, which is designed in the sense of the cost oriented and economical dispatching rule for controlling the generating capacity of those three systems to ensure stable and contingent electricity, is still investigated poorly in the previous works.

Accordingly, it can be seen that the above-described conventional technique still has many drawbacks, and is not designed well, and urgently needs improvement.

In view of the disadvantages derived from the above-described conventional ways, the present inventor had devoted to improve and innovate, and, after studying intensively for years, developed successfully a hybrid clean-energy power-supply framework according to the invention.

SUMMARY OF THE INVENTION

The object of the present invention is to provide a hybrid clean-energy power-supply framework, using a central processing unit to monitor and dispatch each of the power generating and supply systems, calculating accurately the system capacity, determining an optimal generation model, ensuring the reliability of power-supply and reducing the cost of power generation.

The other object of the present invention is to provide a mechanism for a selectively grid-connected or stand-alone power-supply system that is capable of preventing island effect. When the utility power is normal the grid-connected with utility power is selected and once the utility power is interrupted, isolating the utility power and dispatching load, the power-supply of partial loop is continued.

The hybrid clean-energy power-supply framework that can achieve the above-mentioned objects of the present invention is a hybrid clean-energy power-supply framework that integrates a fuel cell, photovoltaic, and wind-power energy. The fuel cell, applying the electrochemical reaction principle, using hydrogen and oxygen as reactants, produces merely pure water, direct current, and waste heat; all such three products are usable resources and the whole process does not produce any pollution and thus is an environmental-protection power generating device; a solar cell uses the photovoltaic effect to convert luminous energy into electric energy, useful solar cells all use silicon having better photoconductivity as the primary material and photovoltaic energy is clean, has no-pollution, and the energy resources are available easily, and it is never exhausted, thus it also is an environmental-protection power generating device; wind-power energy, using electromagnetic principle, specific-structure fan leafs are pushed by wind force to drive the rotator of a DC generator turning for generating direct current, is a clean, no-pollution, and does not require laborious exploitation, is an environmental-protection energy resource supplied by nature directly. In order to match up the power control and electricity dispatching, after all calculations are processed by a central processing unit of an electricity monitoring system, the electricity monitoring system controls the step-up of each power generating system to DC bus such that electricity can be fed into the AC utility power, via an energy conversion system, and supply load.

BRIEF DESCRIPTION OF THE DRAWINGS

The drawings disclose an illustrative embodiment of the present invention that serves to exemplify the various advantages and objects hereof, and are as follows.

DETAILED DESCRIPTION OF THE PREFERRED EMBODIMENT

Figure 1:
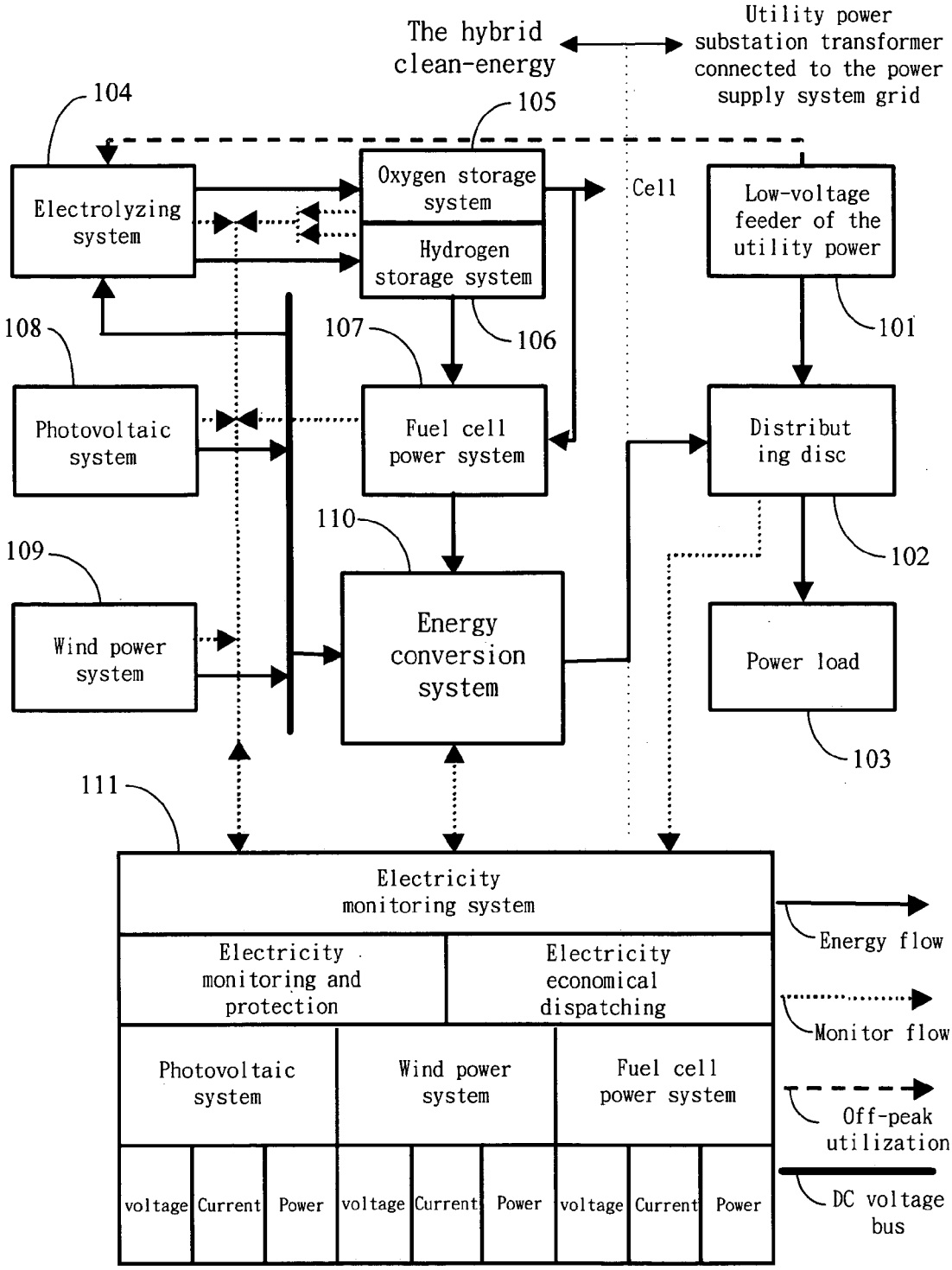
FIG. 1 is a block diagram of a hybrid clean-energy power-supply framework according to the present invention.
Figure 6:
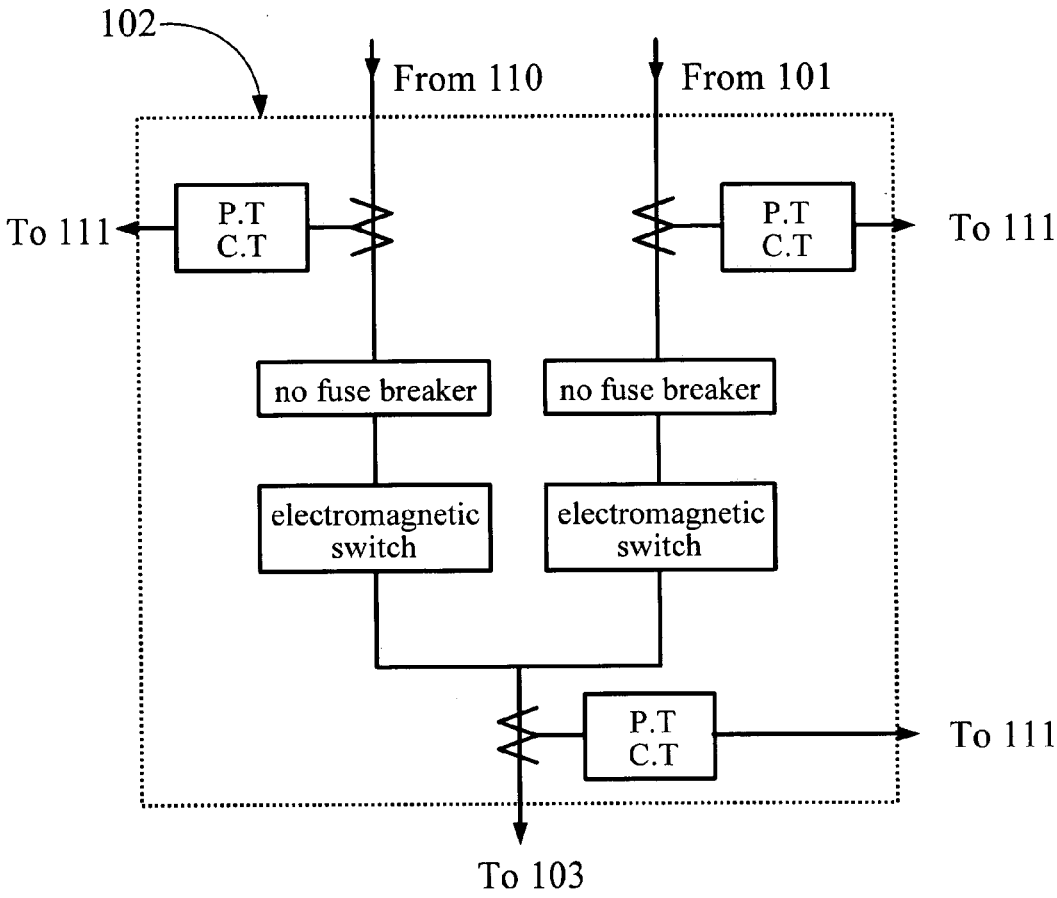
FIG. 6 is a block diagram of the distributing disc of the present invention.

FIG. 1 shows a block diagram of a hybrid clean-energy power-supply framework according to the present invention. Said power-supply system includes an interface for feeding utility power. A general high-voltage client, stepping down the utility power in a transformer of a self-installed distribution substation to get a low-voltage feeder 101 for distribution, through a distributing disc 102, allocates shunts to each load. FIG. 6 shows the distributing disc 102 that comprises: a no-fuse breaker for preventing the conductive wire of the shunt from short-circuit; an electromagnetic switch for controlling the coil of said electromagnetic switch to make/break a shunt thereof and a control signal thereof touch-controlled by a digital switch of a central processing unit; a potential transformer (P.T.) and a current transformer (C.T.) for sending the sensed voltage and current of a shunt to a central processing unit for calculation. The distributing disc 102 has functions for protecting shunt lines and isolating the utility power and power load 103, thus the electric energy generated by a hybrid clean-energy power-supply framework according to the present invention can be fed from the distributing disc 102. A signal, detected by a current transformer and a voltage transformer of said distributing disc 102, is used as a base for power control. At the same time, it can achieve load control and isolate the utility power loop to avoid the island effect by way of controlling the electromagnetic switch to make/break a load loop, In addition, it can prevent the overload phenomena of the hybrid clean-energy power-supply system owing to the interruption of the utility power. The power load 103 is defined as the internal load supplied by a hybrid clean-energy power-supply system, and is also the measurement of power quantities in the present invention.

The electric energy of a hybrid clean-energy resource comes from hydrogen energy, solar energy and wind energy. Hydrogen energy is made from an electrolyzing system 104, oxygen storage system 105, hydrogen storage system 106, and a fuel cell power generating system 107. Hydrogen and oxygen are electrolyzed from water in the electrolyzing system 104, and are subsequently sent to the oxygen storage system 105 and the hydrogen storage system 106 respectively. The required power for electrolyzing water comes from the clean-energy surplus and the night off-peak cheap power. The hydrogen of a hydrogen storage system 106 is the primary fuel of said fuel cell, using catalytic materials such as platinum, silver, nickel, and the like to separate electrons in the hydrogen gas and bring electrons to a load port. Thus a power generating system with an electron flow is formed. The oxygen in the oxygen storage system 106 is a combustion supporting gas required by the chemical reaction in the fuel cell power generating system 107, and the proportion required is smaller than hydrogen gas. After the power generating process is completed the surplus oxygen can be stored for sale to reduce the power generating cost indirectly. The electric power of a photovoltaic system 108 and a wind power generating system 109 are prioritized to feed the electricity required by the power load 103 in the utility power. If surplus power remains then all are provided to the electrolyzing system. The three above-mentioned power generating systems must step up the DC bus of the direct voltage respectively and then transfer power to an energy conversion system 110. The energy conversion system 110, using the pulse width modulation switching mechanism, via a full-bridge converter framework, converting the direct voltage into a sinusoidal voltage with the utility power frequency, thus achieves the objects for controlling the power of feed-in utility power and raising the power factor. An electricity monitoring system 111, as the control center of the present invention, comprises a section for electricity monitoring and protection and another for electricity economical dispatching. The former, is the utilization of the digital signals transformed from the analog signals of voltage and current sensed from each unit for monitoring display data and protecting the system operation at normal. Moreover, the latter is the calculation of current commands in a central processing unit via the voltage and current signals of each loop for controlling each power generating system and the energy conversion system so that the power flow can be determined.

Figure 2:
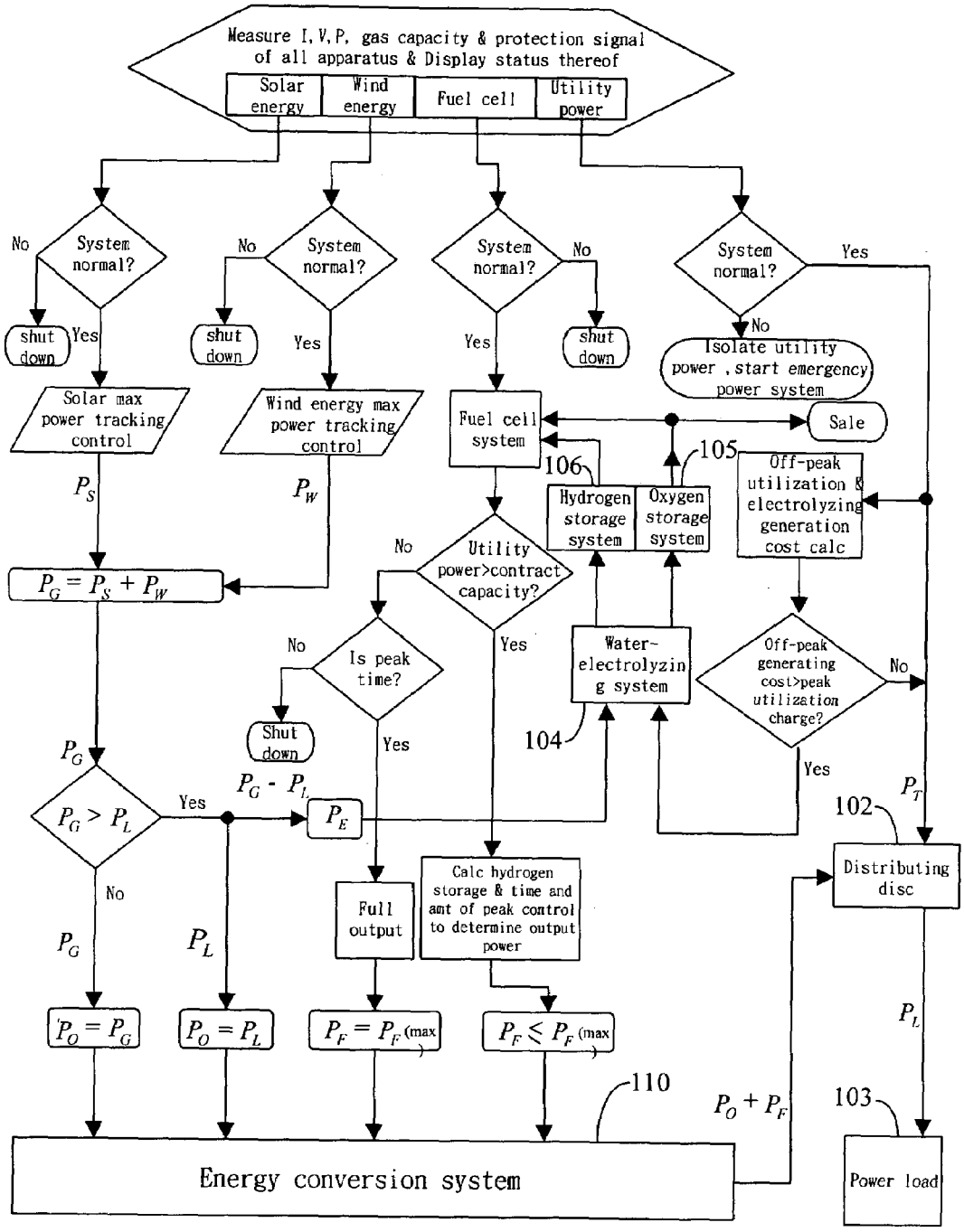
FIG. 2 is a flow chart of a hybrid clean-energy power-supply framework according to the present invention.

FIG. 2 shows a flow chart of a hybrid clean-energy power-supply framework according to the present invention. In a photovoltaic system 108, the generating capacity is directly proportional to the amount of insolation. It has no fuel cost and the useful power can be extracted via a max power tracking control mechanism. The output dc voltage of a solar cell is inversely proportionate with its output dc current. Because the output power is the product of voltage and current in a dc system the max power is the max value of those products. In the tracking control process, because the product of the voltage of a solar cell and the current to be controlled needs to be calculated and must be detected at any time, a lot of on-line data needs to be calculated by a central processing unit with heavy load, and if the control is unstable, the power consumption of an institution will increase and the object for achieving the max power control can not be obtained. Fortunately, at present some methods are disclosed continually that can effectively achieve the max power tracking control comprising: voltage feedback method, power feedback method, perturbation and observation method, incremental conductance method, linear approximation method, actual measurement method, etc. A wind power generating system 109, wherein the output power of a wind-power generator is proportional to the cube of wind speed and the square of the voltage, rotary speed descending while extracted current increased, has a problem of max power tracking control similar with the solar cell, and thus, can be solved by the above-described methods.

Most of the flow chart shown in FIG. 2 relates to the processing of the power balance and economical dispatching of minimum power generating cost. After completing the max power tracking control, the sum $P_G$ of $P_S$, which is the output power of a photovoltaic system 108, and $P_W$, which is the output power of a wind power generating system 109, presents the generating power at no-fuel cost, is fully fed into the utility power, but the surplus power $P_E$ is used to start the electrolyzing system 104, if the sum $P_G$ is greater than the power $P_L$ of the power load 103. There are two reasons why the surplus power $P_E$ does not feed into the utility power by an inverse flow: first, rules and clauses in the Electricity Laws of Taiwan, R.O.C., about feeding the utility power through an inverse flow, has not yet been revised. Thus, the power plant does not have a legal basis for pricing. Second, the over-contract extra charge of the power plant is 2 or 3 times higher than the demand charge, in another words, the over-contract extra charge/15 min/kW is NT$600 or more, 1000 times higher than the energy charge of the same time. Therefore, in order to reduce the over-contract extra-charge, the fuel cell power generating system 107 suppresses the peak power not over contract and further reduces the contract capacity and expense thereof, that is not less the expense of energy charge reduced. Accordingly, increasing the hydrogen storage and oxygen storage can suppress more peak power.

Further, the night off-peak charge only is 10% of the peak charge, so preferably the off-peak utility power is used to electrolyze water and the daytime utility power is outputted from the fuel cell power generating system 107. During the time period of peak utilization, when the power $P_T$ of the utility power from the low-voltage feeder 101 of the power plant is larger than the contract capacity, the fuel cell power generating system 107 is started and the generating power thereof is calculated by a central processing unit of an electricity monitoring system 111, using the history data of the power load 103 to forecast the over-contract amount and the over-contract interval, checking hydrogen storage, to obtain an optimal economical dispatching power. The object of obtaining an accurate calculation is to achieve suppressing peak utilization in order to not exceed the contract capacity at any time. Otherwise, if the average utilization over the contract capacity occurs for 15 minutes just once in a month, then the benefit previously obtained from suppressing the peak utilization will be erased. Furthermore, the capacity of a fuel cell power generating system 107 and a hydrogen storage system 105 may not be enough to suppress the utilization below the contract capacity, therefore averaging the peak utilization may still exceed the contract capacity, but can keep the utilization constant.

Electricity must be released if the capacity of the hydrogen storage system 106 has been saturated. When the cooler is stopped in winter or the utilization is lower on holiday, in less over-contract case, the fuel cell power generating system 107 can be outputted with max generating power $P_{F(max)}$ until hydrogen storage consumed to the safety stock thereof in peak pricing time phase. And the surplus gas of the oxygen storage system can be sold to increase additional revenue. On the whole, the fuel cell power generating system 107 produces hydrogen using the cheaper electricity at night, and thereafter uses the same hydrogen to generate electricity during the day in order to reduce the peak energy charge and over-contract charges. Even after deducting the losses due to the chemical recycle reaction, the system still has a profit.

Figure 3A:
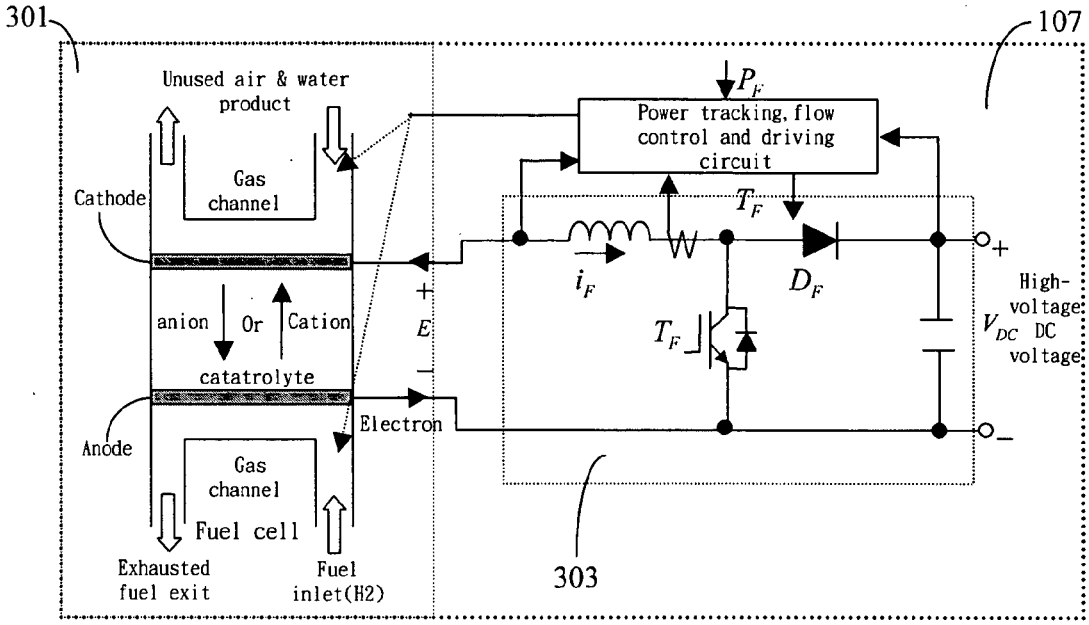
FIGS. 3(*a*), (*b*), and (*c*) are the schematic diagram of an embodiment of a hybrid clean-energy power-supply framework according to the present invention.
Figure 3B:
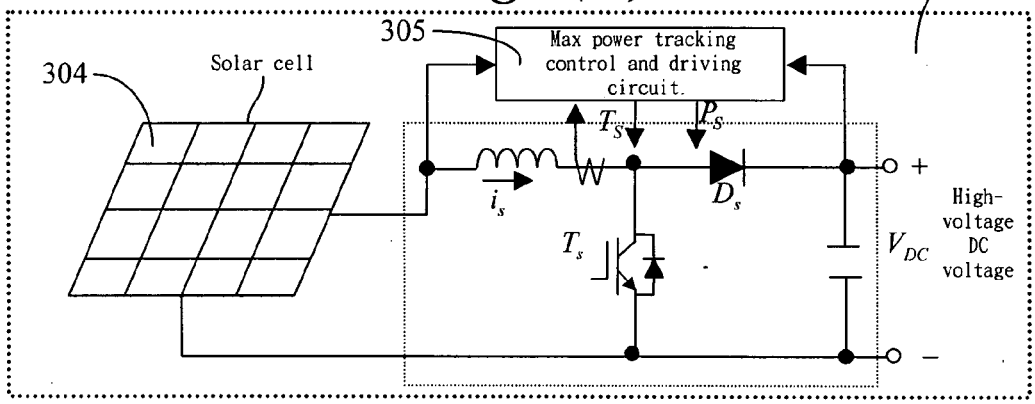
Figure 3C:
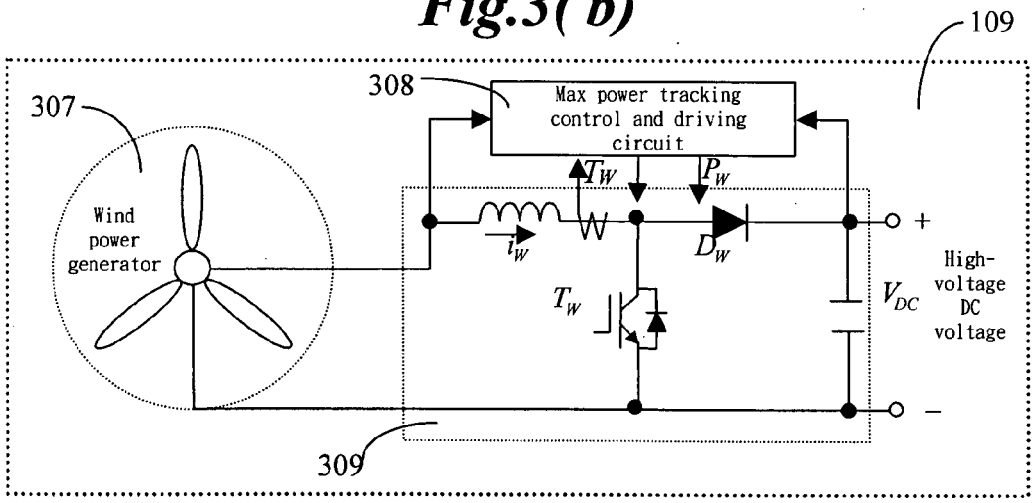

FIG. 3 shows an embodiment of a hybrid clean-energy power-supply framework according to the present invention. FIG. 3(*a*) shows a fuel cell power generating system, FIG. 3(*b*) shows a photovoltaic system, and FIG. 3(*c*) shows a wind power generating system. Because the location to install the power generating systems are separate from the distributing disc 102, the solar cell must be installed on the roof, the wind driven power generator 307 installed outside of the house mostly, and the power transmission line should be long enough to integrate those three power generating systems. In order to reduce the power transmission loss, there is a need to step up the stable direct voltage most near the power generating system. The direct voltage power transmission line is better than an AC power transmission system and has several advantages such as no skin effect, no electromagnetic interference, less power transmission loss, no inductance constrained max transmission power, etc. Furthermore, Occident's response to the power transmission problem of renewal energy gradually reaches a consensus to establish a voltage specification of high-voltage DC bus. All converters in those three power generating system, the DC booster and converter circuit 303 of a fuel cell 301, the DC booster and converter circuit 306 of a solar cell, and the DC booster and converter circuit of a wind power generator 309, are adjusted by an inductance current to achieve the object of power control. The output direct voltage of a power generating system is measured by a voltage sensor and is known data. This known data is multiplied by the output average current (conductance current) of the power generating system to be controlled, and this product is the output power of the power generating system. The circuit framework uses a booster-type converter, the cycle of the pulse width modulation (PWM) switching is D, the input and output voltage of the converter is $V_{IN}$ and $V_{DC}$, then the voltage gain $G_V$ can be obtained from:

$$G_V = \frac{V_{DC}}{V_{IN}} \frac{1}{1-D} \tag{1}$$

The cycles D of switching of the converters of three power generating systems are determined, respectively, by the power tracking, flow control, and the driving circuit 302 of a fuel cell, by the max power tracking control and the driving circuit 305 of a solar cell, and by the max power tracking control and the driving circuit 308 of a wind power generator. Since the solar and wind energy must be extracted with the max power, there is a need to create a max power tracking control rule in a central processing unit, via calculating the sensed voltage signal outputted from a DC generating apparatus, to obtain a switching cycle D command. The max power tracking control and the driving circuit 305 of a solar cell further includes a sun tracking mechanism for controlling solar energy control plates perpendicular to the sun light to obtain the maximum amount of insolation. This part can be achieved by using a motor to elevate the system and an illuminometer for coordination. The maximum power tracking control and the driving circuit 308 of a wind power generator further includes: a windward mechanism for controlling the angle of wind-leafs and the excitation voltage so as to absorb the maximum mechanical energy. Because the fuel cell must consider factors such as the peak utilization, power generating cost, etc., the adjustment of the switching cycle D command varies with the utilization and generating power respectively. As regards the control of keeping the DC bus constant, the adjustment can depend on the feed-in utility power size, in other words, when the direct voltage is kept on a predetermined value, this shows the feed-in utility power equals to the total generating power of those three clean-energy systems. When the central processing unit receives a signal showing interruption, under-phase, or under-voltage of the utility power, the loop of the utility power in the distributing disc 102 is cut-off and isolated immediately and the output power of those three power generating system are calculated accurately. Then the load loop parallel in the distributing disc 102 is chosen, based on the emergency priority of supplying power, to adjust the output power $P_F$ of the fuel cell power generating system as a balance mechanism of power generation and utilization.

Figure 4:
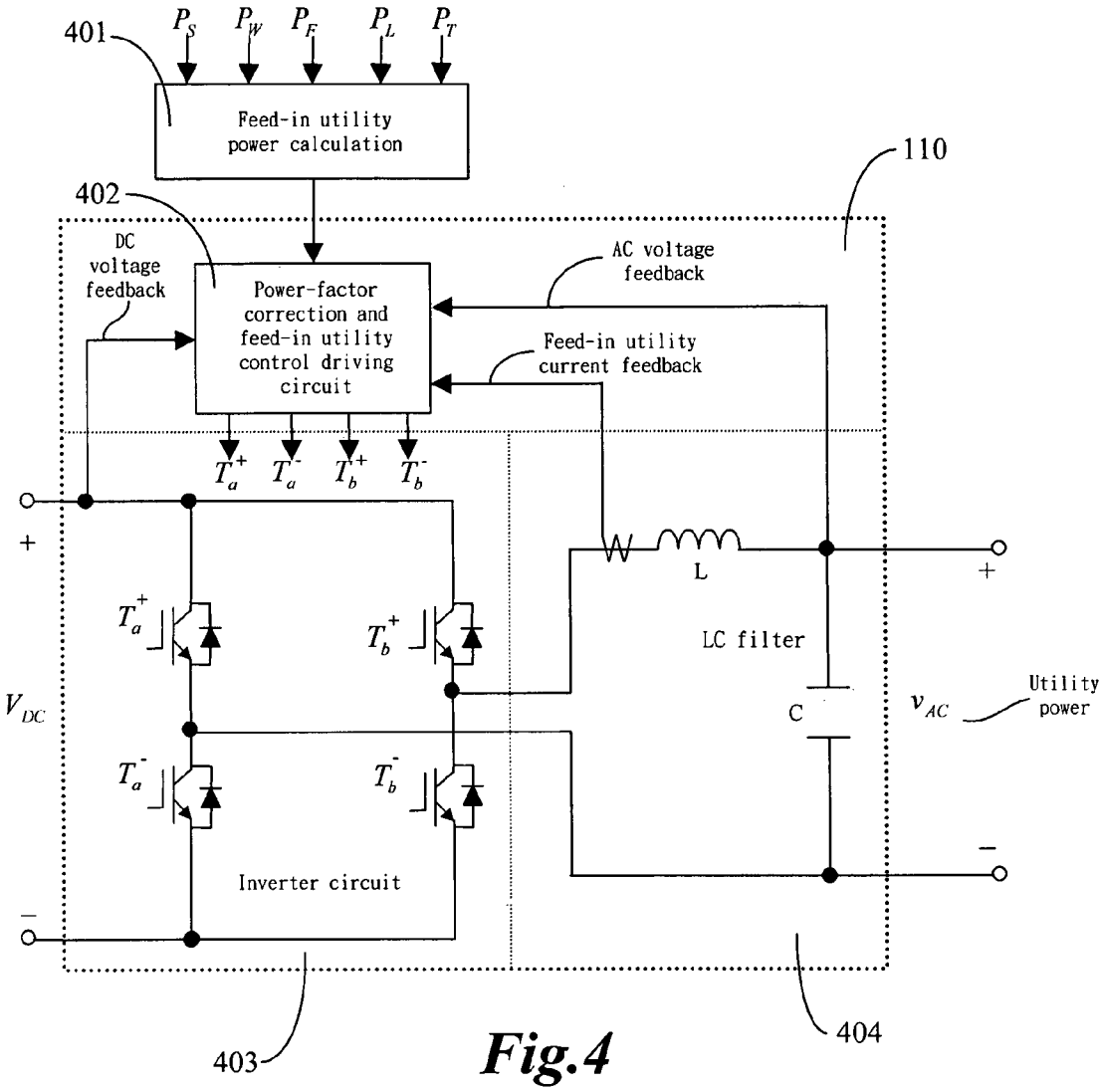
FIG. 4 shows an energy conversion system diagram of an embodiment of a hybrid clean-energy power-supply framework according to the present invention.

FIG. 4 shows an energy conversion system diagram of an embodiment of a hybrid clean-energy power-supply framework according to the present invention. The power calculation of the feed-in utility power 401, which is a function of the electricity monitoring system 111, contains the output power of all power generating systems and each loop power of the utility power to obtain the net output power of the power generating system. It sends this net output power signal to the control driving circuits of power factor correction and the feed-in utility power 402. The power factor correction circuit can convert the direct current command of the feed-in utility power into an AC sync current command to control the four switch-driving signals of the inverter circuit 403 and force the inductance current of the LC filter 404 tracking the AC sync current command. If the voltage of the DC bus is kept at a predetermined value, this then indicates that the power generation and the power supply is in balance. Otherwise, if the DC bus voltage is larger, this indicates that the power generation is higher than the feed-in utility power; the feed-in utility power should be raised. When the phase of the sinusoidal current of the feed-in utility power is the same as the utility power $v_{AC}$, the reactive power is zero, power factor is 1, and thus can minimize the bus current of the hybrid clean-energy power-supply framework according to the present invention, improve the voltage wave, and further raise the overall efficiency of the energy conversion system 110.

Figure 5:
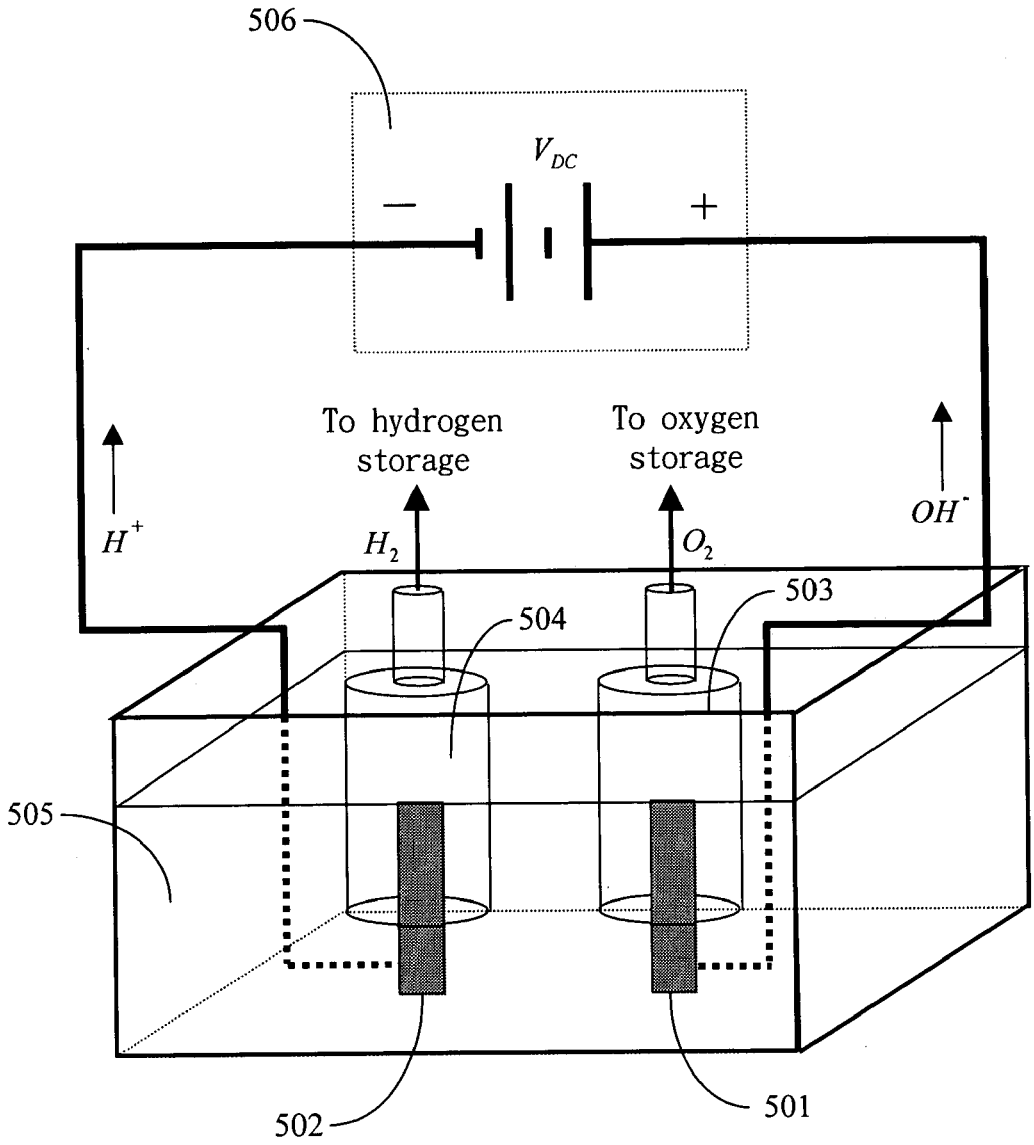
FIG. 5 is a schematic diagram of an apparatus for electrolyzing water into hydrogen and oxygen of an embodiment of a hybrid clean-energy power-supply framework according to the present invention.

FIG. 5 shows a schematic diagram of an apparatus for electrolyzing water into hydrogen and oxygen of an embodiment of a hybrid clean-energy power-supply framework according to the present invention. In general, pure water is quite difficult to be electrolyzed, usually adding sodium hydroxide or sulfuric acid 505 to facilitate electric conduction, and using carbon rods or injection needle as electrodes. A positive carbon rod 501 is connected to the positive voltage of the direct voltage bus 506; a negative carbon rod 502 is connected to the negative voltage of the direct voltage bus 506. As a direct current is introduced to the electrodes, OH ions in the water move to the positive electrode of the direct voltage bus 506, and oxygen can be collected by the inlet of an oxygen collector 503 at the positive electrode and sent to the oxygen storage system 105. But $H^+$ ions move to the negative electrode, where hydrogen can be collected by the inlet of a hydrogen collector 503 at the negative electrode and sent to the hydrogen storage system 105. During electrolyzing, the higher voltage of the direct voltage bus 506 or the closer of two electrodes, the faster speed of producing bubbles from electrolyzing. Because the density of the hydrogen and oxygen produced is smaller than water and does not dissolve in water, the method utilizing such a feature to collect gas is known as the drainage gas-gathering method.

As compared with other conventional techniques, the hybrid clean-energy power-supply framework according to the present invention has the following advantages:

1. The present invention is a hybrid clean-energy power-supply framework, wherein using the favorable price of the off-peak utility power (from 10:00 pm to 7:30 am set in a dual meter), to electrolyze water to create hydrogen and oxygen for storage; because the peak energy charge is 1.5 times or more than the off-peak energy charge, starting the fuel cell to generate electricity during the daytime, that not only reducing energy charge (total utilization kWH×price/kWH), but also suppressing the peak utility power to reduce the over-contract charge about NT$316/kW to about NT$648/kW. Furthermore, the stored hydrogen can be used as a green gas battery for providing emergency electricity during the utility power interruption. The surplus oxygen can be sold for use in medical treatment or oxygen welding.

2. The present invention uses a fuel cell to replace a battery and can supply electricity continuously. The generating power of a solar cell and a wind power generator is subject to the environment, time, and climate. The amount of insolation, for example, is directly related to proximity to the equator, the higher illuminance, larger in the summer than in the winter due to longer days and sunshine time, but power generation obviously must stop at night. The wind power generator, installed along coastal regions, creates more electricity during northeast monsoon due to winds blowing from the north of Taiwan, the generating time is not limited to the daytime, but air flow is not stable and timing-easy as the solar illuminance. Summarizing the above, the generating capacities of the solar cell and wind power generator, has complementary relationship partially, that is, those two generating electricity tending to balance in various time phase or in different regions. However, the wind-power generating stops at night or when air flow ceases. The solution of a general stand-alone power-supply system is to add a battery for providing electricity continuously. When the depth of discharge is 100%, the average life of a lead-acid battery is about 300 times, the depreciation cost of this equipment is several times of the utility power, and more a battery has faults such as large volume, heavy weight, low storage capacity, and the environmental-protection problem after scrapped. Thus the above two power generating systems, although no need on fuel cost, once if using storage batteries, achieving the object and pragmatism of clean-energy is difficult.

Many changes and modifications in the above-described embodiment of the invention can, of course, be carried out without departing from the scope thereof. Accordingly, to promote the progress in clean-energy technology and the useful arts, the invention is disclosed and is intended to be limited only by the scope of the appended claims.

What is claimed is:

1. A hybrid clean-energy power-supply framework comprising:

a low-voltage feeder of a power plant, outputted from a substation transformer stepping down the utility power, self-installed by a general high-voltage client;

a distributing disc, an apparatus for feeding a hybrid clean-energy power-supply system, protecting shunt lines, and isolating the utility power of the power plant;

a power load, an internal low-voltage load of a client;

an electrolyzing system, an apparatus that uses a DC power source to electrolyze water into hydrogen and oxygen;

an oxygen storage system, an apparatus for storing oxygen produced by water electrolyzing into a metal container;

a hydrogen storage system, an apparatus for storing hydrogen produced by water electrolyzing into a metal container;

a fuel cell power generating system, a DC power generating apparatus that uses hydrogen gas as fuel via a catalytic material selected from gold, silver, nickel, and the like to separate electrons in the fuel, and introduces said electrons to an end of the power load to form an electron flow;

a photovoltaic system, a solar DC power generating apparatus that is composed of solar cells;

a wind power generating system, a DC power generating apparatus that uses wind energy to rotate the leaves of a wind power generator;

an energy conversion system, an apparatus that converts the direct voltage outputted from the fuel cell power generating system, the photovoltaic system, and the wind power generating system into an alternating voltage for feeding the utility power;

an electricity monitoring system, comprising a central processing unit, an analog/digital input/output conversion interface, a voltage and current sensor, and a display circuit, where said monitoring system, via checking signals, and by a calculation process controls the output power of said three power generating system respectively, and provides trigger-signals for apparatus protected;

said hybrid clean-energy power-supply framework integrating the fuel cell power generating system, the photovoltaic system, and the wind power generating system, wherein said system converts direct current into alternating current via the energy conversion system and the electricity monitoring system.

2. The hybrid clean-energy power-supply framework of claim 1, wherein said distributing disc comprises:

a no fuse breaker, protecting the conducting wire of said shunt lines from short circuit;

an electromagnetic switch, using a signal controlled by a digital switch of said central processing unit to conduct the coil of said electromagnetic switch to make/break the load of said shunt lines belonging to said electromagnetic switch;

a potential transformer (P.T.) and a current transformer (C.T.), the potential and current signal sensed by said shunt lines being reduced to a certain percentage and sent to said central processing unit for calculation.

3. The hybrid clean-energy power-supply framework of claim 1, wherein two direct currents used by said electrolyzing system are introduced by two loops respectively, the first is supplied by the utility power during off-peak favorable pricing period, the second is supplied from the redundant electricity from the photovoltaic system and the wind power generating system after supply to the power load; all hydrogen gas produced from electrolyzing being used in the fuel cell power generation and part of oxygen gas produced from electrolyzing being used to react with hydrogen ions to form water and the other oxygen is stored for sale.

4. The hybrid clean-energy power-supply framework of claim 1, wherein said fuel cell power generating system comprises:

a fuel cell, an output power tracking, a flow control, a driving circuit of said fuel cell, a DC booster and a converter circuit of said fuel cell;

starting the fuel cell power generating system primarily for suppressing peak utilization and providing emergency source such that the output power tracking is calculated by a central processing unit that outputs a switching cycle command to the DC booster and converter circuit to adjust an intended conductance current, the average of said intended conductance current is multiplied by the output voltage of said fuel cell to obtain an output power of said fuel cell power generating system; and in order to match up the generating power, using a flow control mechanism, the flow and pressure of hydrogen and oxygen gas being adjusted to balance the fuel supply and achieve the optimal chemical reaction.

5. The hybrid clean-energy power-supply framework of claim 1, wherein said photovoltaic system comprises a solar cell, a max power tracking control, a driving circuit, a DC booster and a converter circuit; wherein said max power tracking control and driving circuit comprises a surpass sun mechanism and a max power extraction arithmetic unit, and the extracted max power of said solar cell is the max power generating efficiency since no need for fuel, said surpass sun mechanism adjusts solar cell plates and the angle of the solar cell plates perpendicular with the sunlight; due to the relationship between the output voltage and current of said solar cell proportional inversely and nonlinearly each other, using a central processing unit to handle the complex determination of voltage and current during extraction, after calculating said max power tracking, using an output of said central processing unit first to control the angle of the solar cell plates to obtain the highest insolation, and subsequently said central processing unit outputting a switching cycle command to modulate the inductance current of said DC booster and converter, the average of said inductance current multiplied by the output voltage of said solar cell to obtain said max output power of the solar cell power generating system.

6. The hybrid clean-energy power-supply framework of claim 1, wherein said wind power generating system comprises a wind power generator, a max power tracking control and driving circuit, a DC booster and converter circuit; wherein said max power tracking control and driving circuit comprises a windward mechanism and a arithmetic unit for extracting max power, and the extracted max power of wind power generator is the max power generating efficiency because only the thrust of wind force is required, and the output power of a wind power generator is proportional with the three power of rotary speed, uses a central processing unit to create a mechanism of said max power tracking operation; said windward mechanism first controlling the angle of wind-leafs and an excitation voltage to obtain a max mechanical energy, and subsequently said central processing unit outputting a switching cycle command to modulate an inductance current of said DC booster and converter circuit, the average of said inductance current multiplied by the output voltage of said wind power generator to obtain said max output power of said wind power generating system; the present claim further comprising: using a DC power generator directly, or using an AC power generator that converts AC into DC via an electronic circuit of electricity to replace said DC power generator.

7. The hybrid clean-energy power-supply framework of claim 1, wherein said energy conversion system comprises a power-factor correction and feed-in utility power control circuit, an inverter circuit, and an LC filter; the power command of the energy conversion system controlled by a central processing unit, as a DC signal, said power-factor correction and feed-in utility power control circuit converting said command into a AC sinusoidal current signal synchronized with the voltage of the utility power, and subsequently forming a pulse modulation signal after compared with a pyramidal wave, driving the four switches of said inverter and forcing the inductance current of said LC filter track said AC sinusoidal current signal synchronized with the voltage of the utility power, and feeding a direct current into the utility power for achieving the object of power-factor correction and improving the wave quality of the AC voltage and raising the efficiency of the energy conversion system.

* * * * *